US011663878B2

(12) United States Patent
Boudreau et al.

(10) Patent No.: US 11,663,878 B2
(45) Date of Patent: May 30, 2023

(54) COMPUTATIONAL DEVICE AND SYSTEM WITH SWITCHABLE GLASS

(71) Applicant: IGT, Las Vegas, NV (US)

(72) Inventors: Bradley Boudreau, Dieppe (CA); Dwayne Nelson, Las Vegas, NV (US); James Vasquez, Carson City, NV (US)

(73) Assignee: IGT, Las Vegas, NV (US)

( * ) Notice: Subject to any disclaimer, the term of this patent is extended or adjusted under 35 U.S.C. 154(b) by 607 days.

(21) Appl. No.: 16/275,020

(22) Filed: Feb. 13, 2019

(65) Prior Publication Data

US 2020/0258349 A1 Aug. 13, 2020

(51) Int. Cl.
*G07F 17/32* (2006.01)
*G07F 17/34* (2006.01)

(52) U.S. Cl.
CPC ..... *G07F 17/3213* (2013.01); *G07F 17/323* (2013.01); *G07F 17/3227* (2013.01); *G07F 17/34* (2013.01)

(58) Field of Classification Search
CPC ..... G07F 13/3213; G07F 17/3227; G07F 17/323; G07F 17/34; G07F 17/3211; G07F 17/3206
See application file for complete search history.

(56) References Cited

U.S. PATENT DOCUMENTS

2007/0021218 A1* 1/2007 Okada ..... G07F 17/3206 463/47
2007/0041095 A1* 2/2007 Nakaya ..... G07F 17/3211 359/463
2012/0270648 A1* 10/2012 Rasmussen ..... G07F 17/3211 463/30
2013/0102390 A1* 4/2013 Klein ..... G07F 17/3211 463/37
2017/0169653 A1* 6/2017 Froy ..... G07F 17/3251
2017/0287287 A1* 10/2017 Froy ..... G07F 17/3211
2018/0253931 A1* 9/2018 Maddox ..... H04N 13/398

* cited by examiner

*Primary Examiner* — William H McCulloch, Jr.
*Assistant Examiner* — Ankit B Doshi
(74) *Attorney, Agent, or Firm* — Sheridan Ross P.C.

(57) ABSTRACT

The present disclosure relates generally to computational devices and systems that include smart glass or switchable glass. A computational device may include instructions that receive an indication of game events as the game events occur and are displayed with a user interface of the computational device, instructions that determine, based on the indication of the game events, whether switchable glass is to be in the first state or the second state, and instructions that provide a control signal to a driver circuit consistent with the determination of whether the switchable glass is to be in the first state or the second state.

12 Claims, 10 Drawing Sheets

COMPUTATIONAL DEVICE AND SYSTEM WITH SWITCHABLE GLASS

BACKGROUND

The present disclosure is directed toward computational devices and systems and, in particular, toward computational devices and systems that include switchable glass.

Active glass, switchable glass, or smart glass are terms commonly used to refer to a glass material in which the opacity of the glass can be changed. Many types of switchable glass require variations in an electrical charge to change the opacity of the glass, but some types of switchable glass can have their opacity controlled by variations in applied light, heat, and/or voltage.

BRIEF SUMMARY

In certain embodiments, the present disclosure relates to a computational device, including: a user interface; switchable glass positioned in proximity with the user interface; a driver circuit that switches the switchable glass between a first state and a second state that is different from the first state; a processor coupled with the user interface and also coupled with the driver circuit; and a computer-readable storage medium, coupled with the processor, comprising instructions that are executable by the processor, wherein the instructions comprise: instructions that receive an indication of game events as the game events occur and are displayed with the user interface; instructions that determine, based on the indication of the game events, whether the switchable glass is to be in the first state or the second state; and instructions that provide a control signal to the driver circuit consistent with the determination of whether the switchable glass is to be in the first state or the second state.

In some embodiments, the present disclosure also relates to a method of operating a computational device, including: displaying outputs of game events with a user interface of the computational device; receiving, at a processor of the computational device, an indication of a sensitive game event; determining, at the processor and based on the indication of the sensitive game event, a control signal to provide to a driver circuit that controls a state of switchable glass positioned in proximity with the user interface of the computational device; providing the control signal from the processor to the driver circuit; and adjusting, by the driver circuit and consistent with the control signal, the state of the switchable glass.

In some embodiments, the present disclosure also relates to a system that includes: switchable glass; a driver circuit that adjusts a state of the switchable glass by providing different levels of current to the switchable glass; a processor coupled with the driver circuit; and a computer-readable storage medium, coupled with the processor, comprising instructions that are executable by the processor, wherein the instructions comprise: instructions that provide a player with a presentation of a plurality of game events; instructions that determine a first game event from the plurality of game events comprises a sensitive game event; and instructions that provide a control signal to the driver circuit that causes the driver circuit to adjust the state of the switchable glass to a translucent state during the first game event.

Additional features and advantages are described herein and will be apparent from the following Description and the figures.

DETAILED DESCRIPTION

Figure 1A:
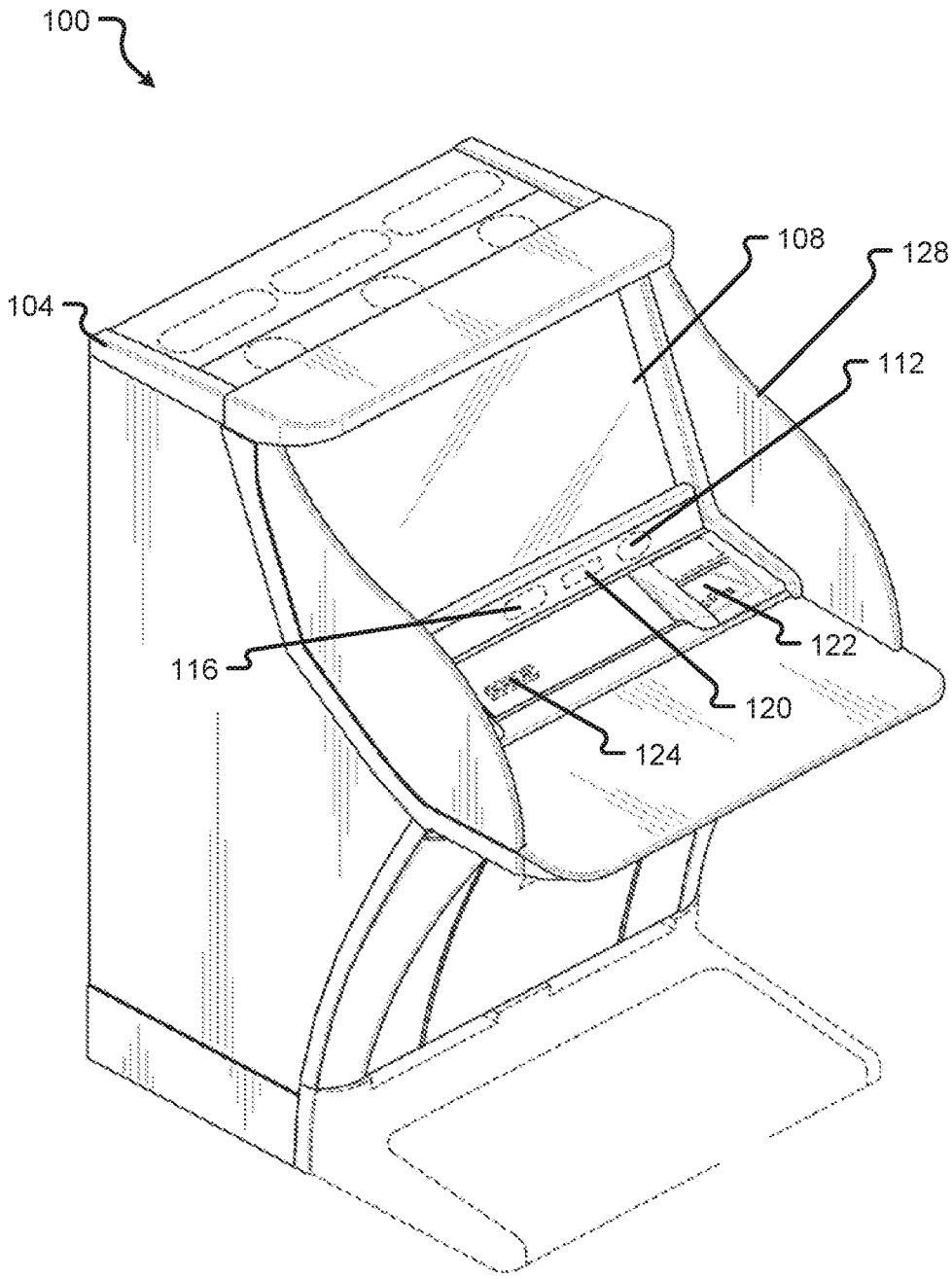
FIG. 1A depicts one example of a computational device in accordance with embodiments of the present disclosure.

Embodiments of the present disclosure will be described in connection with a computational device and, in particular, a computational device, such as a slot machine or Electronic Gaming Machine (EGM), that make use of switchable glass. While embodiments of the present disclosure will be described in connection with the example of a slot machine or EGM having switchable glass, it should be appreciated that embodiments of the present disclosure are not so limited. For instance, other types of computational devices, such as portable user devices, smartphones, tablets, laptops, Personal Computers (PCs), wearable devices, etc. may be used provided with switchable glass without departing from the scope of the present disclosure.

Switchable glass or smart glass is a material (e.g., a glass material or a glazing for glass material) whose light transmission properties can be altered when current, voltage, light, and/or heat applied to the material are altered. Switchable glass can come in many forms include, without limitation, liquid crystal devices, suspended particle devices, switchable devices, and reflective hybrids. Liquid crystals respond to an electrical charge by aligning perpendicular to the charged surface, allowing light to pass. When the electrical charge is absent, these liquid crystals can become randomly oriented. The disadvantage of liquid crystals is that there are no intermediate light settings, meaning that the switchable glass is either clear or opaque and nothing in between those two states.

Another technology used in switchable glass utilizes small light-absorbing microscopic particles known as suspended particle devices (SPD). These particles align in straight lines perpendicular to the conductive layer, enabling light to pass through the switchable glass. Once the voltage is removed, these particles move back into a random pattern. The disadvantage of SPD technology is that the switchable glass must be continually charged for the material to be transparent.

Reflective hybrids reflect light instead of absorbing light as with the SPD technologies. This type of switchable glass may include a layer of nickel-magnesium alloy sandwiched between two glass panels which may be controlled to switch back and forth between a transparent and reflective state. This type of smart-glass is controlled by a low voltage or injection of hydrogen or oxygen gases.

Other types of switchable glass can be configured to darken when a voltage is applied and are otherwise transparent when the voltage is removed. Specifically, within switchable glass, a switchable film layer may be applied to an ion conductor which layers on top of an ion storage layer. These three layers are sandwiched between two panels of glass or plastic each coated with a conductive oxide. A control device can be configured to manually or automatically control the voltage applied to the conductive oxide. When energized by an electrical current, a chemical reaction begins within the switchable film that makes the film change color. The chemical reaction may be an oxidation reaction where molecules of a compound lose an electron. Ions in the sandwiched switchable layers enable the material to change from opaque to transparent. The ions allow the switchable glass to absorb light. Thus, when a voltage is applied to the conductive oxide layers formed on the panels of switchable glass, the voltage drives the ions from the ion storage layer through the ion conducting layer and into the switchable layer. This reaction effectively enables the switchable layer to function as a light valve by changing color when energized by this voltage. As a result, the switchable layer becomes opaque and blocks light by darkening when a voltage is applied to the conductive coating on the panels of glass. When the amount of voltage is decreased, the ions are driven out of the switchable layer into the ion storage layer. When the ions leave the switchable layer, the window lightens and regains its transparency. Once the voltage is removed, the film changes back to a translucent film, effectively allowing the light to pass from one glass panel to the next. This type of switchable glass only requires electricity to generate the chemical reaction, where the window maintains its color without having constant application of a voltage.

As used herein, the term switchable glass or smart glass may include electrochromic devices, photochromic devices, thermochromic devices, suspended particle devices, microblind devices, and polymer-dispersed liquid crystal devices. Any of these devices may include glass, plastic, or some other material as a substrate. Thus, the term "glass" should not be construed to limit embodiments of the present disclosure to silica-based materials, but rather can include polymer-based materials or other transparent materials with a film or glazing provided adjacent thereto. Moreover, the opacity of the device may be altered by changing the opacity of the substrate itself, a film provided over the substrate, a glazing provided over the substrate, or a combination thereof.

Embodiments of the present disclosure contemplate the use of switchable glass or smart glass in a gaming environment. A common use for switchable glass is for privacy. Within the context of a gaming environment, the switchable glass can be dynamically changed from one state to another based, for example, on content being displayed during a player's interaction with a game. Studies have shown that certain types of game players, such as sports betting players, prefer more privacy than other types of players. In accordance with some embodiments, a computational device is disclosed to include switchable glass that is automatically switched from a first state (e.g., a transparent state) to a second state (e.g., an opaque or translucent state) in response to determining that a sensitive game event is occurring during game play. The degree and position of transparency or opacity may be variable and could depend upon player preferences.

In one embodiment, the state of the switchable glass may be adjusted to introduce a blurring effect for the player. For example, the switchable glass may be configured to automatically blur when the player is making a monetary decision. In another example, the blurring can be activated when the player is entering sensitive information such as a PIN, password, address, or the like. In another example, the blurring could be activated when a player is using the service window to make a purchase or redeem player points. As a non-limiting example, the automated control of the switchable glass may be reserved for only certain players that possess a loyalty account or have obtained a certain level of status within a casino.

In some embodiments, the privacy preferences could be stored with the player loyalty account or on a player mobile device so that the settings associated with the privacy preferences are automatically applied when the player plays at a device. In an embodiment, the computational device could adjust the transparency or opacity of the switchable glass based on a security state of the computational device. Many computational devices, such as EGMs, are currently enabled to use a candle as an indicator of certain conditions. Embodiments of the present disclosure contemplate the ability to replace these candles with a device having switchable glass that can be flashed, blurred, or otherwise have its appearance modified to indicate certain conditions. Examples of such conditions include, without limitation, door open indicators, player service requests, or hand pay.

As will be discussed in further detail herein, the switchable glass may be provided over a user interface (e.g., a display portion of a user interface). In the example of an EGM or the like, the switchable glass may be provided over a top box, over one or more physical reels, over a monitor, over a bill acceptor, and/or over bell glass. The switchable glass could be configured to hide or show specific areas of a user interface for various gaming functions.

In one embodiment, the switchable glass can be configured to hide or show the top box according to game state. As an example, when the top box is enabled due to a bonus feature, the switchable glass can be controlled in such a way as to reveal the top box to the player and provide the top box bonus. After the bonus, the player can instruct the switchable glass to hide the top box. Alternatively or additionally, an automated routine executed by the processor could be configured to switch the glass from one state to another state to hide the top box.

In one embodiment, the switchable glass can be configured to hide or show one or more physical reels of a slot machine or slot game. As an example, the switchable glass can be controlled for various game features that would add or remove reels as appropriate (e.g., in response to appropriate bets and/or in response to bonus features provided by the game). In a simple but non-limiting example, the EGM can be converted from a 3-reel to a 4-reel game by using switchable glass to show the fourth reel when the terminal is configured for play with the additional fourth reel. In another embodiment, the EGM can be configured to add an additional reel for a bonus feature. In another example, the game randomly chooses 3 of the 4 reels to use when the player spins the reels.

In one embodiment, the belly glass, or portions thereof, is hidden or shown to indicate the EGM is enabled or disabled.

In some embodiments, switchable glass can be provided as part of a table game such as poker or blackjack. One or more switchable glass panels could be placed to cover decorative features of the table game surface. Each of the switchable glass panels could be configured to hide or show various table game elements in a dynamic fashion. For example, a certain side bet might only be available in certain conditions. When the side bet is disabled, the switchable glass can hide the side bet option by frosting the switchable glass panel over the side bet area of the table. When the side bet is enabled, the switchable glass can be changed to a transparent state so the player can see the option of a side bet is available.

The term "a" or "an" entity refers to one or more of that entity. As such, the terms "a" (or "an"), "one or more," and "at least one" can be used interchangeably herein. It is also to be noted that the terms "comprising," "including," and "having" can be used interchangeably.

Figure 1B:
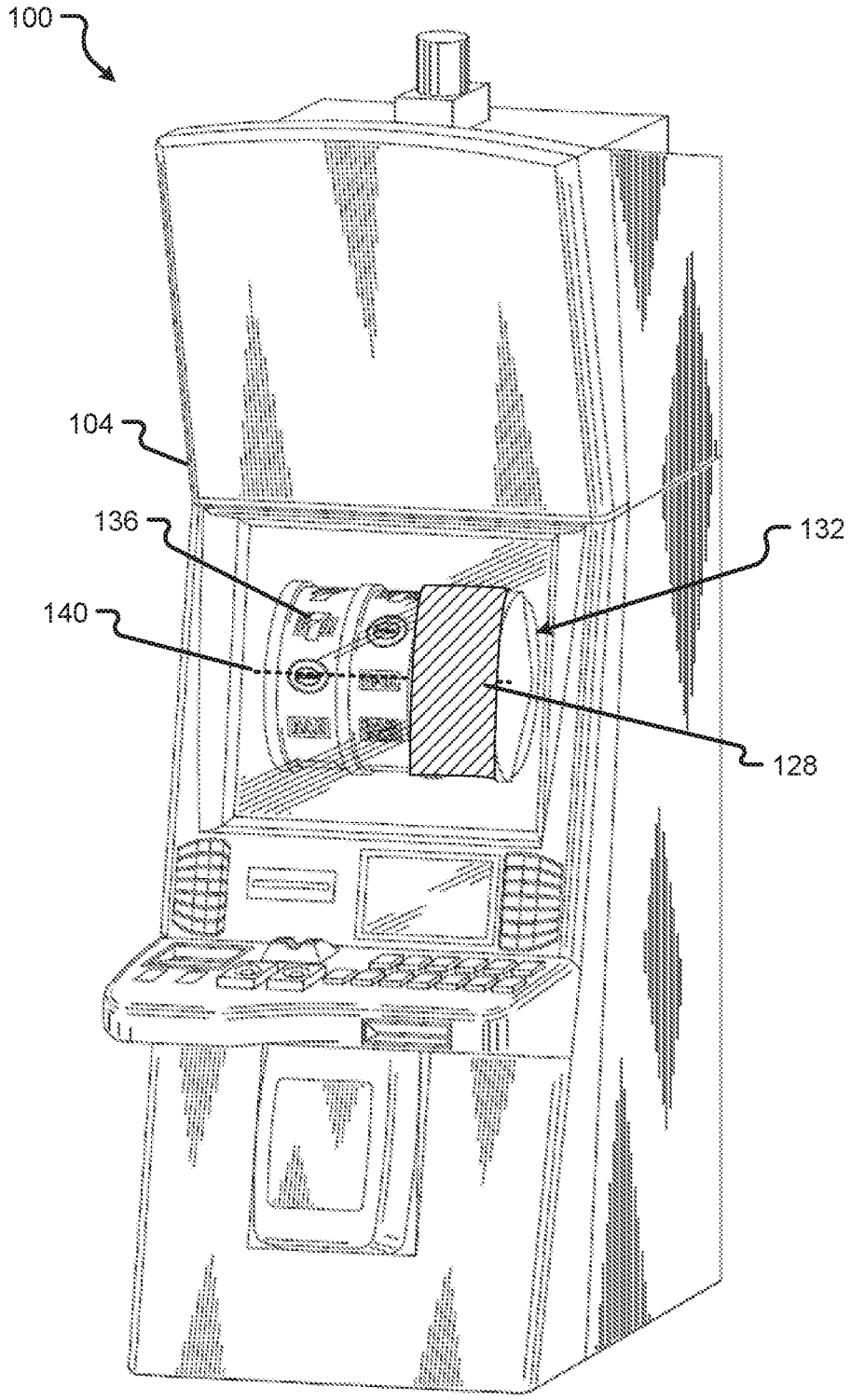
FIG. 1B depicts another example of a computational device in accordance with embodiments of the present disclosure.
Figure 1C:
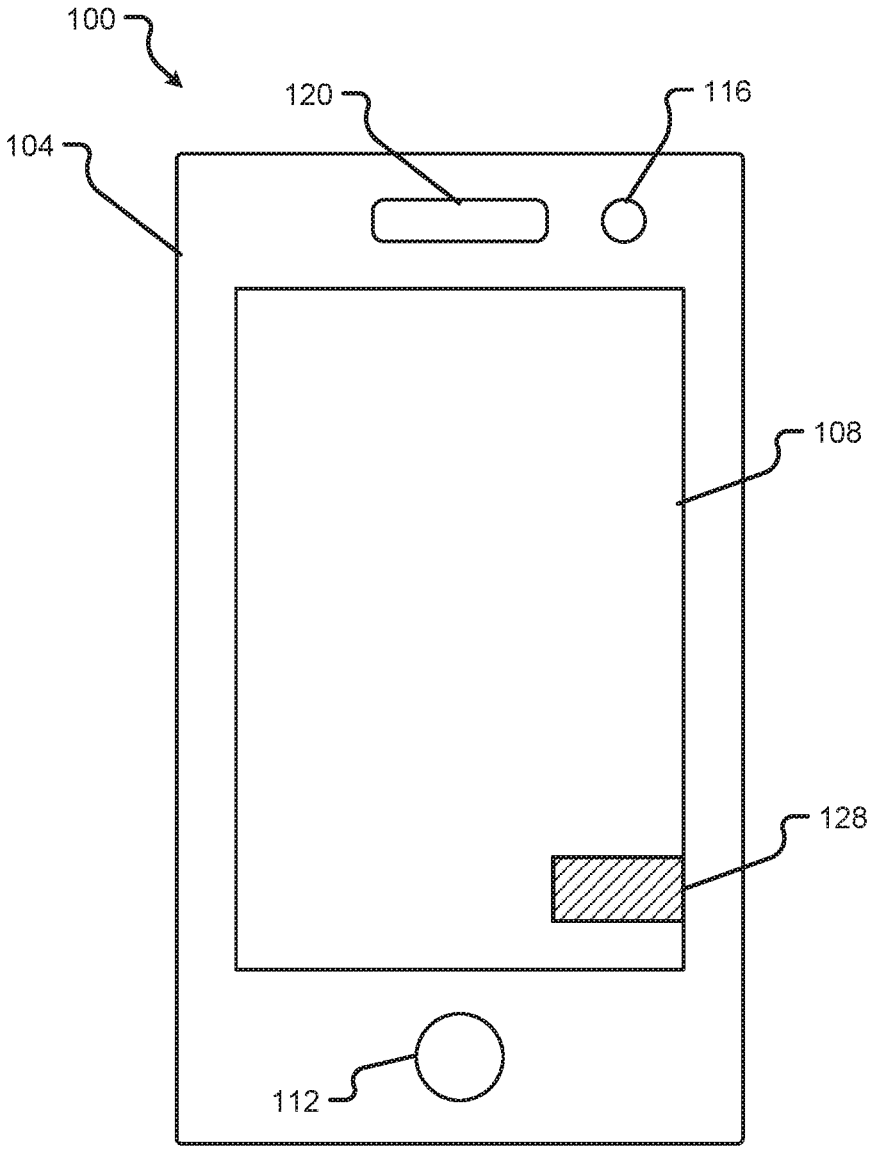
FIG. 1C depicts another example of a computational device in accordance with embodiments of the present disclosure.

With reference now to FIGS. 1A-1C, an illustrative computational device 100 that may be configured with switchable glass 128 will be described in accordance with at least some embodiments of the present disclosure. A computational device 100 may include a portable or non-portable device used for executing a gaming application or multiple different gaming applications without departing from the scope of the present disclosure. Of course, a computational device 100 does not necessarily have to implement a gaming application. Rather, a computational device may correspond to any device that operates on user inputs and provides user outputs via a user interface. Non-limiting examples of a computational device include an EGM, a VGM, a mobile communication device (e.g., a smartphone, laptop, wearable device, etc.), a laptop, a PC, etc. An EGM or VGM-type of computational device 100 is shown in FIGS. 1A and 1B in accordance with embodiments of the present disclosure. A mobile communication device version of the computational device 100 is shown in FIG. 1C.

The illustrative computational device 100 of FIG. 1A is shown to include a support structure 104, housing or cabinet, which provides support for a plurality of displays 108, inputs 112, 116, 120, controls, and other features of a conventional gaming machine. In the illustrated embodiment, a player plays computational device 100 while sitting, however, the computational device 100 is alternatively configured so that a player can operate it while standing or sitting. The illustrated computational device 100 is positioned on the floor but can be positioned alternatively (i) on a base or stand, (ii) as a pub-style table-top game (e.g., where the participant computational devices are located remotely from the shared wheel as discussed below), (iii) as a stand-alone computational device on the floor of a casino with other stand-alone computational devices, or (iv) in any other suitable manner. The computational device 100 can be constructed with varying cabinet and display configurations.

In one embodiment, a computational device 100 is configured to randomly generate awards and/or other game outcomes based on probability data. Since a computational device 100 generates outcomes randomly or based upon a probability calculation, there is no certainty that the computational device 100 will provide the player with any specific award or other game outcome.

In some embodiments, a computational device 100 may employ a predetermined or finite set or pool of awards, progressive awards, prizes or other game outcomes. As each award or other game outcome is provided to the player, the computational device 100 removes the provided award or other game outcome from the predetermined set or pool. Once removed from the set or pool, the specific provided award or other game outcome cannot be provided to the player again. The computational device 100 provides players with all of the available awards or other game outcomes over the course of the play cycle and guarantees a designated amount of actual wins and losses.

The computational device 100 may include one or more displays 108. An illustrative display 108 may include a light emitting diode (LED) panel, an organic LED (OLED) panel, a liquid crystal display (LCD), or any other type of device that is capable of rendering images for display to a user of the computational device 100. In some embodiments, the display 108 may correspond to a touch-sensitive display. The display 108 may also include other types of devices that can present information to a user via a plurality of pixels. In general, the display 108 corresponds to a particular type of visual output device. Although not depicted, the computational device 100 may further include other types of output devices, such audio output devices (e.g., speakers, buzzers, etc.), tactile output devices (e.g., haptic feedback systems, vibration motors, etc.), or any other known transducer that is configured to convert an electrical signal into a physical property capable of being sensed by a user.

In addition to the display 108, the computational device 100 may include a number of different input devices 112, 116, 120. In some embodiments, the computational device 100 may include a biometric sensor device 112, an image sensor device 116, and an audio input device 120. The image sensor device 116 may include any type of imaging device, such as a camera, an image sensor, a CMOS-based image sensor, a CCD-based image sensor, etc.

The biometric sensor device 112 may include a number of image sensors or may be integrated with the image sensor device 116. In some embodiments, the biometric sensor device 112 may correspond to a particular type of image sensor device that is used to detect or sense a biometric feature of a user. For instance, the biometric sensor device 112 may be used to detect a user's fingerprint, retina, ear lobe, facial features, etc. In other words, the biometric sensor device 112 may correspond to a particular input of the computational device 100 that is used to detect one or more biometric features of a user, perhaps as part of authenticating a user and enabling certain features of the computational device 100.

The audio input device 120 may correspond to one or more transducers that convert audible sounds (e.g., sound waves) into an electrical signal. In some embodiments, the audio input device 120 may correspond to a microphone, a pressure sensor, or the like. Any device or collection of devices capable of sensing a sound wave and converting the sound wave into an electrical signal may be provided as an audio input device 120.

The computational device 100 is also shown to include at least one payment acceptor. Illustrative payment acceptors may include, without limitation, a coin slot 124, where the player inserts coins or tokens, and a ticket, note or bill acceptor 122, where the player inserts a bar-coded ticket, note, or cash. In one embodiment, the note or bill acceptor 122 may also be configured as a player-tracking card, credit card, debit card or data card reader/validator. In such an embodiment, the acceptor 122 may operate as a more generic type of document reader rather than a particular type of document reader, such as a ticket, note, or bill acceptor.

In one embodiment, a player inserts an identification card into acceptor 122 of computational device 100. The identification card can be a smart card having a programmed microchip or a magnetic strip coded with a player's identification, credit totals and other relevant information. In one embodiment, money may be transferred to computational device 100 through an electronic fund transfer and acceptor 122 using the player's credit, debit or smart card. When a player funds computational device 100, a processor of the computational device 100 may determine the amount of funds entered and the corresponding amount is shown on the credit or other suitable display 108 as described above.

The computational device 108 is further shown to include two panels of switchable glass 128 provided as side panels. The switchable glass 128 may be configured to switch between two or more states in which the switchable glass 128 exhibits various amounts of transparency/opacity. In some embodiments, the switchable glass 128 is controlled, at least in part, based on events that occur during game play. For instance, the switchable glass 128 may be changed to different colors to indicate a particular event has occurred during game play. As another example, the switchable glass 128 may be switched from a transparent state to a translucent or opaque state to provide additional privacy for a player at the computational device 100. The switchable glass 128 may be switched to the translucent or opaque state for only portions of game play (e.g., when play credits or win amounts are depicted on display 108, when bet options are being selected by a player, etc.). Alternatively, the switchable glass 128 may be switched to the translucent or opaque state for the entirety of a player's gaming session while at the computational device 100, possibly to accommodate privacy preferences for the player. In some embodiments, the switchable glass 128 may be in a transparent state when the computational device 100 is operating in an attract mode (e.g., when there is not a player currently playing the game and the game is attempting to attract a player to the computational device 100), but then may be switched to a translucent or opaque state when the computational device 100 is operating in a game play mode.

FIG. 1B illustrates another example of a computational device 100 in accordance with at least some embodiments of the present disclosure. The computational device 100 of FIG. 1B corresponds to another type of EGM, such as a slot machine, having a set of reels 132. The set of reels 132 may include two, three, four, or more individual reels 136. In some embodiments, the reels 136 may correspond to physical reels that rotate about a reel drum. In some embodiments, the reels 136 may correspond to virtual or video reels that are displayed with a plurality of pixels on a display 108.

As can be appreciated, a slot game may also include one or more pay lines 140 that traverse the set of reels 132. In some embodiments, symbols displayed on each reel 136 after the reel 136 is done spinning may be evaluated relative to the pay line 140 to determine if a player has won a predetermined award. The computational device 100 is also shown to include a panel of switchable glass 128 positioned in proximity with at least one of the reels 136. The switchable glass 128 may be switched between a first state (e.g., a transparent state) and a second state (e.g., a translucent or opaque state) to selectively display or hide a reel 136. In some embodiments, the switchable glass 128 may be configured to display a bonus reel 136 (e.g., a fourth reel) during a bonus game play, but may otherwise obfuscate or hide the bonus reel 136 during normal game play.

FIG. 1C illustrates another example of a computational device 100 in accordance with at least some embodiments of the present disclosure. This particular example of computational device 100 may correspond to a portable computational device 100 such as a mobile smartphone, tablet, wearable, etc. The computational device 100 may be owned by a user of the device 100 rather than being owned by a casino operator.

The computational device 100 again includes a support structure 104, a display 108, one or more input devices 112, 116, 120. In some embodiments, the display 108 may correspond to a touch-sensitive display screen, meaning that the display 108 is simultaneously capable of displaying information (e.g., in connection with game play activity) and receiving a touch-based user input on the two-dimensional surface of the display 108. In some embodiments, the touch-sensitive display 108 may provide game features similar to a cabinet-style computational device 100 without requiring all of the dedicated buttons provided by a cabinet-style computational device 100. The computational device 100 of FIG. 1C is shown to have a portion of the display 108 overlapped by the switchable glass 128. In some embodiments, the switchable glass 128 may be configured to display or hide a particular portion of information presented via display 108 during game play. In other words, the switchable glass 128 does not necessarily have to overlap the entirety of the display 108, but rather may only overlap and selectively hide a portion of the display 108.

Figure 2:
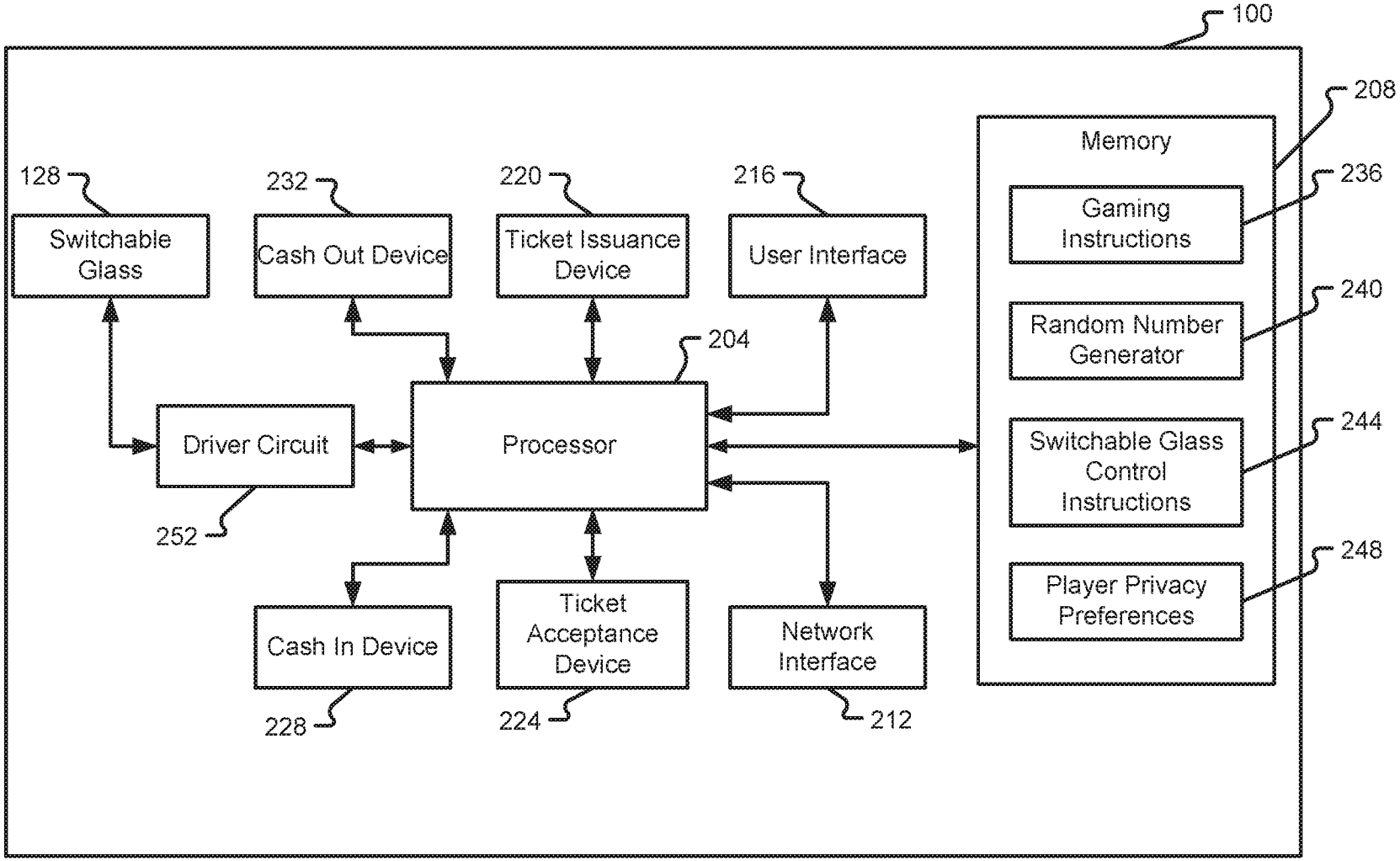
FIG. 2 is a block diagram depicting components of a computational device in accordance with embodiments of the present disclosure.

With reference now to FIG. 2, additional details of the components that may be included in a computational device 100 will be described in accordance with at least some embodiments of the present disclosure. The computational device 100 is shown to include a processor 204, memory 208, a network interface 212, and a user interface 216. In some embodiments, the processor 204 may correspond to one or many microprocessors, CPUs, microcontrollers, Integrated Circuit (IC) chips, or the like. The processor 204 may be configured to execute one or more instruction sets stored in memory 208. In some embodiments, the instruction sets stored in memory 208, when executed by the processor 204, may enable the computational device 100 to provide game play functionality or any other type of desired functionality.

The nature of the network interface 212 may depend upon whether the network interface 212 is provided in cabinet-style computational device 100 or a mobile computational device 100. Examples of a suitable network interface 212 include, without limitation, an Ethernet port, a USB port, an RS-232 port, an RS-485 port, a NIC, an antenna, a driver circuit, a modulator/demodulator, etc. The network interface 212 may include one or multiple different network interfaces depending upon whether the computational device 100 is connecting to a single communication network or multiple different types of communication networks. For instance, the computational device 100 may be provided with both a wired network interface 212 and a wireless network interface 212 without departing from the scope of the present disclosure.

The user interface 216 may include a combination of the user input and user output devices described in connection with FIGS. 1A-1C. For instance, the user interface 216 may include the display 108 and the user input devices 112, 116, 120. The user interface 216 may also include one or more drivers for the various hardware components that enable user interaction with the computational device 100.

The memory 208 may include one or multiple computer memory devices that are volatile or non-volatile. The memory 208 may be configured to store instruction sets that enable player interaction with the computational device 100 and that enable game play at the computational device 100. Examples of instruction sets that may be stored in the memory 208 include a gaming instruction set 236, a random number generator 240, and a switchable glass control instruction set 244. In addition to the instruction sets, the memory 208 may also be configured to store player privacy preferences 248, which, in some embodiments, may be referenced by the switchable glass control instructions 248 to determine whether/when to change the switchable glass 128 from one state to a different state.

One, some, or all of the instruction sets shown as being stored in memory 208 may correspond to an executable set of instructions that perform a predetermined function on defined inputs and then produce one or more outputs based on the predetermined function. In some embodiments, the gaming instruction set 236, when executed by the processor 204, may enable the computational device 100 to facilitate one or more games of chance or skill and produce interactions between the player and the game of chance or skill. In some embodiments, the gaming instruction set 236 may include subroutines that present one or more graphics to the player via the user interface 216, subroutines that calculate whether a particular wager has resulted in a win or loss during the game of chance or skill, subroutines for determining payouts for the player in the event of a win, subroutines for exchanging communications with another device, such as a server, subroutines for determining bonus spin opportunities during game play, and any other subroutine useful in connection with facilitating game play at the computational device 100. The gaming instruction set 236 may utilize or call the random number generator 240 to generate one or more random numbers as seeds or inputs for the gaming instruction set 236. The random number generator 240 may help to ensure that game events produced by the gaming instruction set 236 are random and not predetermined.

In some embodiments, the switchable glass control instruction set 244 may be configured to monitor operations, inputs, and outputs of the gaming instruction set 236. Specifically, the switchable glass control instruction set 244 may be configured to monitor game play events that occur during execution of the gaming instruction set 236 and based on the game play events determine whether or not (and to what extent) the switchable glass 128 should be changed from one state to a different state. For instance, the switchable glass control instruction set 244 may be configured to determine that a particular game event is occurring via execution of the gaming instruction set 236 and that the particular game event requires the switchable glass 128 to change from a transparent state to an opaque state. The switchable glass control instruction set 244 may be configured to provide one or more control signals to a driver circuit 252 that indicate the need to change the state of the switchable glass 128. The driver circuit 252 may then be configured to apply the appropriate current, voltage, heat, and/or light to the switchable glass 128 to effect the desired change of state.

In some embodiments, the switchable glass control instruction set 244 may be configured to receive and store player privacy preferences 248 in memory 208. The player privacy preferences 248 may be received, for example from a player loyalty card or from a player's personal mobile device. The player privacy preferences 248 may include one or more preferences that define a desired operation of the switchable glass 128 during game play. For instance, player privacy preferences 248 may indicate that the player desires all credit information to be obfuscated from others. This preference may be accommodated by selectively changing the switchable glass 128 from a transparent state to an opaque state to obfuscate any credit information for that player. When the player is done playing the computational device 100, the player privacy preferences 248 may be erased from memory 208 or otherwise ignored by the switchable glass control instruction set 244 for subsequent game play by other players. In some embodiments, player privacy preferences 248 for one player may be replaced with player privacy preferences for another player when the new player begins their game play session at the computational device 100. The switchable glass control instruction set 244 may be configured to reference the player privacy preferences 248 to determine whether a particular game event corresponds to a sensitive game event and, therefore, justifies obfuscation with the switchable glass 128.

The computational device 100 is further shown to include a ticket issuance device 220, a ticket acceptance device 224, a cash in device 228, and a cash out device 232. The ticket issuance device 220 may be configured to receive physical tickets, vouchers, or player loyalty cards. In some embodiments, the ticket issuance device 220 and ticket acceptance device 224 may operate in concert with the acceptor 122. In such an embodiment, the acceptor 122 may correspond to the physical components that receive and issue a ticket or voucher whereas the ticket acceptance device 224 and ticket issuance device 220 correspond to the drivers and/or firmware components that control operation of the acceptor 122.

Similarly, the cash in device 228 and cash out device 248 may include or operate in concert with the coin slot 124 and any coin delivery mechanisms. The cash in device 228 and cash out device 248 may include hardware, drivers, or firmware that facilitate receiving or distributing cash, tokens, bills, etc. In some embodiments, the cash in device 228 may be configured to determine an amount of cash (e.g., in coins, bills, etc.), an amount of tokens, etc., input at the coin slot 124 and convert the values into credits for playing games with the game instruction set 220. The cash out device 248 may correspond to hardware and software configured to output coins, tokens, bills, etc. if a player decides to cash out or convert playing credits back into cash, tokens, bills, etc.

The nature and configuration of the driver circuit 252 may depend upon the nature of the switchable glass. For instance, if the switchable glass 128 is controllable by application of different voltages or currents, then the driver circuit 252 may be configured to apply or stop application of a voltage or current to the switchable glass 128 in response to a control signal received from the process 204 (e.g., based on execution of the switchable glass control instruction set 244). As can be appreciated, that driver circuit 252 may include one or more logic circuit elements (e.g., transistors, logic gates, switches, etc.), one or more analog circuit elements (e.g., resistors, capacitors, inductors, etc.), one or more amplifiers, or any other type of circuit component useful in connection with controlling a state of the switchable glass 128. As another example, if the switchable glass 128 is controllable by application of different lights to the switchable glass 128, then the driver circuit 252 may include one or more photodiodes or LEDs that are configured to produce a light in response to electrical current applied thereto. As another example if the switchable glass 128 is thermochromic, then the driver circuit 252 may include one or more thermal transducers that are configured to produce thermal energy (e.g., heat) in response to having an electrical current applied thereto.

Figure 3A:
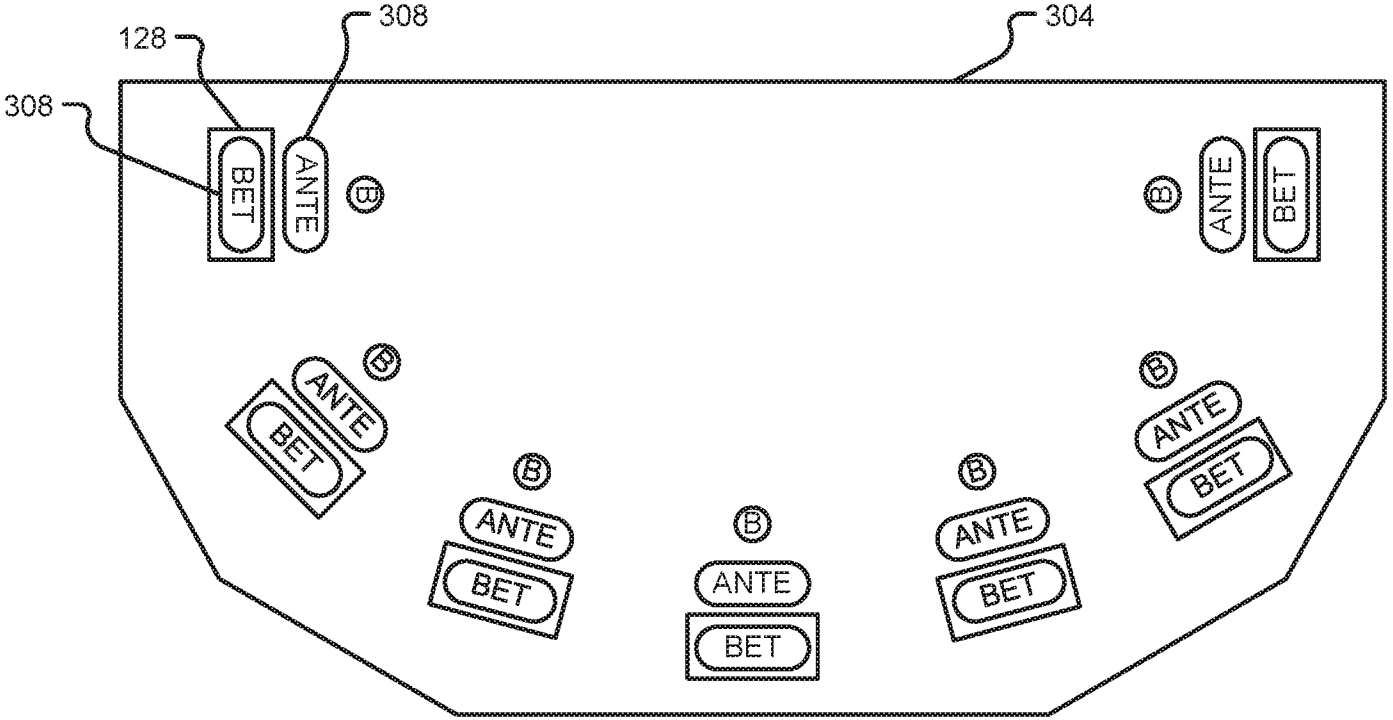
FIG. 3A is a top view of a table game surface in a first state in accordance with embodiments of the present disclosure.

With reference now to FIGS. 3A-3E, another variant of device that may be configured with switchable glass 128 will be described in accordance with at least some embodiments of the present disclosure. Specifically, a table game surface 304 is shown to include a plurality of table graphics 308 and one or more sections of switchable glass 128. As shown in FIG. 3A, a section of switchable glass 128 may be configured to overlap a table graphic 308 such that the table graphic 308 is visible when the switchable glass 128 is in a transparent state.

Figure 3B:
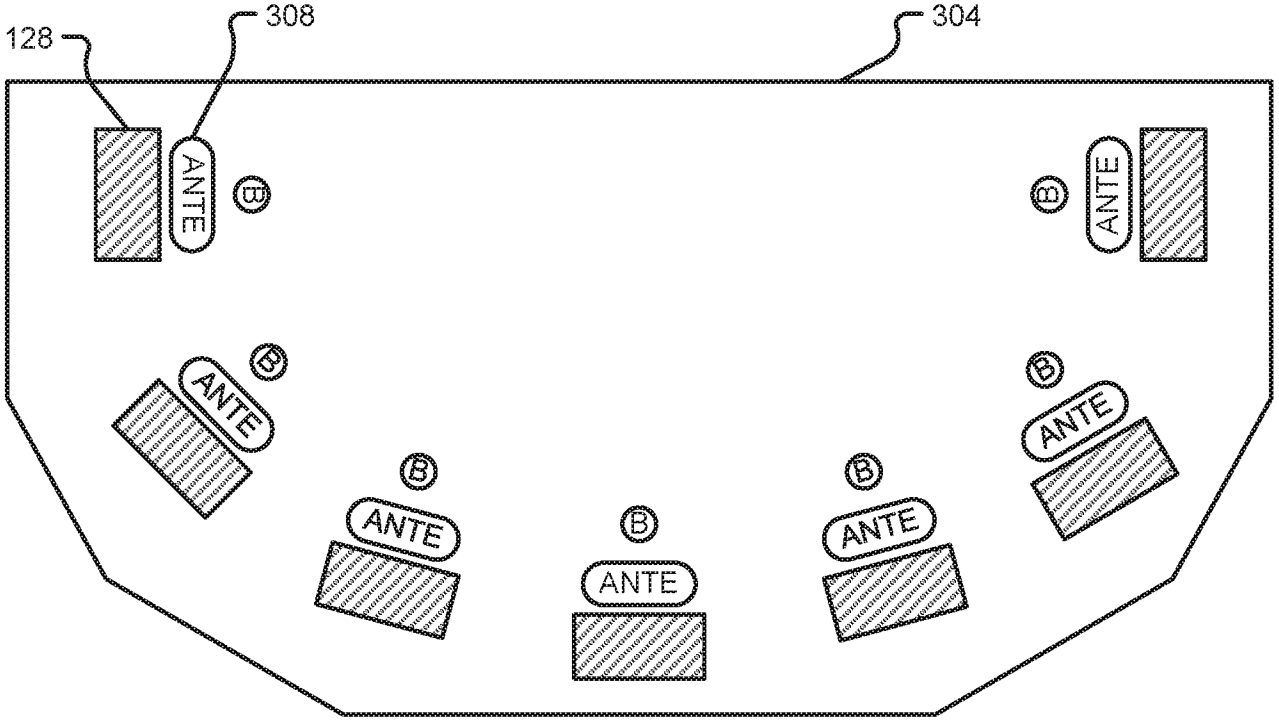
FIG. 3B is a top view of the table game surface of FIG. 3A in a second state in accordance with embodiments of the present disclosure.

As shown in FIG. 3B, however, the table graphic 308 may be obfuscated or hidden when the switchable glass 128 is switched to an opaque or translucent state. In some embodiments, each section of switchable glass 128 may be controlled by a common driver circuit 252 such that all sections of switchable glass 128 are always switching from one state to another at substantially the same time. In some embodiments, each section of switchable glass 128 may be controlled by a different driver circuit 252 such that each section of switchable glass 128 can be individually switched from one state to another without having to switch a state of the other switchable glass 128 sections. As can be appreciated, the switchable glass 128 may be switched to an opaque state to hide particular betting options when such betting options are not offered for the table game.

Figure 3D:
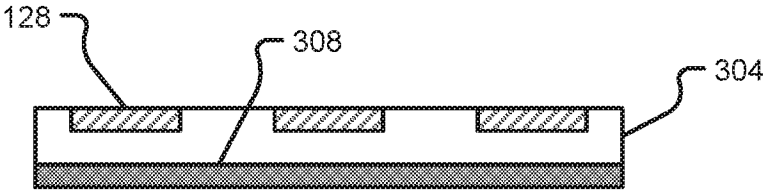
FIG. 3D is a cross-sectional view of a table game surface having a second construction in accordance with embodiments of the present disclosure.
Figure 3C:
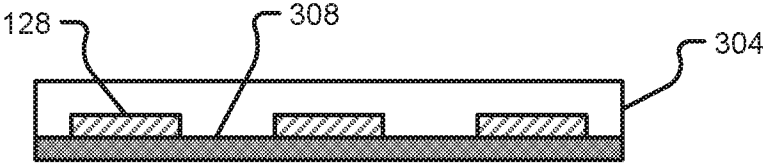
FIG. 3C is a cross-sectional view of a table game surface having a first construction in accordance with embodiments of the present disclosure.
Figure 3E:
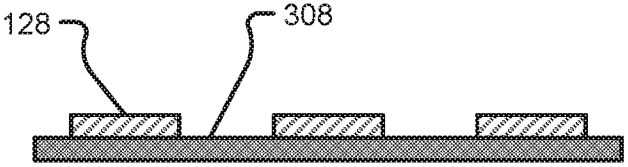
FIG. 3E is a cross-sectional view of a table game surface having a third construction in accordance with embodiments of the present disclosure.

As can be seen in FIGS. 3C-3E, the overlapping relationship of the switchable glass 128 relative to a layer of the tabling having graphics 308 can be modified in a number of ways without departing from the scope of the present disclosure. In some embodiments, the graphics 308 are provided as a base layer that has the switchable glass 128 provided thereon. All of the sections of switchable glass 128 may rest directly on the graphics 308 and then may be covered with the table game surface 304 so as to provide a substantially flat playing surface for all players of the table game.

Alternatively, as shown in FIG. 3D, the sections of switchable glass 128 may be provided with their top surfaces substantially flush with a top plane of the table game surface 304. In this way a slight gap may be provided between the graphics 308 and the switchable glass 128. Such a configuration may provide the players with a better view of the graphics 308 when the switchable glass 128 is in a transparent state. This particular configuration may also create a sense of depth between the switchable glass 128 and graphics 308, which may be visually pleasing to players of the table game.

FIG. 3E illustrates yet another possible configuration where the substantially flat table game surface 304 is removed and the sections of switchable glass 128 rest atop the graphics 308. In this configuration, the game play surface may not necessarily correspond to a flat or flush surface, but rather the switchable glass 128 may sit proud of the rest of the game play surface, which may correspond to a felt or similar non-woven material with graphics 308 printed thereon.

Figure 4:
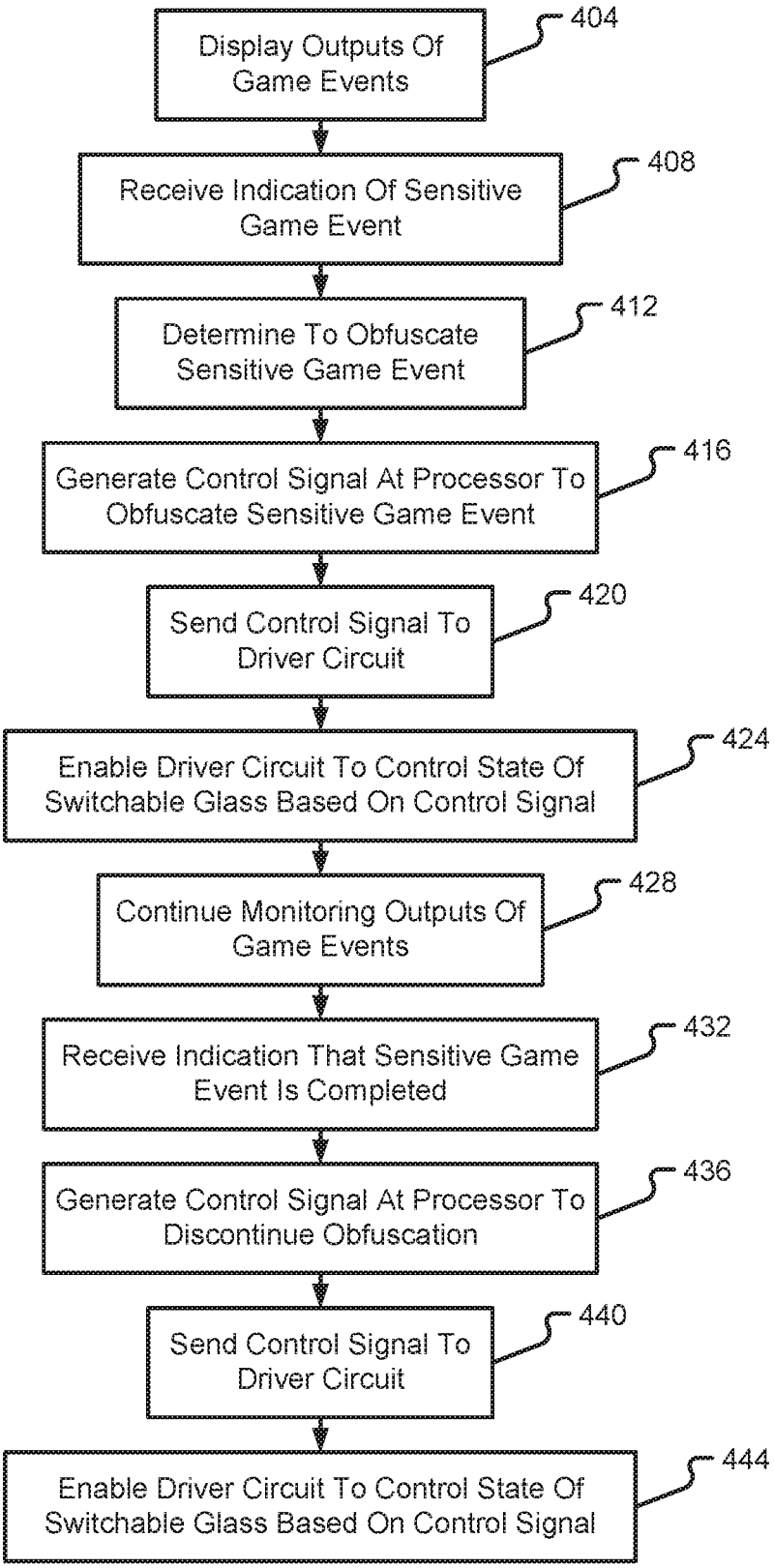
FIG. 4 is a flow chart depicting a first method in accordance with embodiments of the present disclosure.

With reference now to FIG. 4, a first method will be described in accordance with at least some embodiments of the present disclosure. The method begins with the processor 204 executing the gaming instruction set 236 during a game play session. As the game play session progresses the gaming instruction set 236 will cause various outputs to be presented to the player via the display 108 and/or user interface 216 (step 404). Also during the game play session the player may be allowed to provide inputs to the gaming instruction set 236, for example, to define betting credits, to identify pay lines desired for evaluation, etc. While the processor 204 is executing the gaming instruction set 236 the switchable glass control instruction set 244 may be executed by the processor 204 in parallel to monitor the various game events being produced as a result of executing the gaming instruction set 236.

In some embodiments, the method continues with the processor 204, via execution of the switchable glass control instruction set 244, receiving an indication that a sensitive game event is occurring in connection with execution of the gaming instruction set 236 (step 408). As can be appreciated, a sensitive game event may correspond to any number or combination of events that can occur during game play. Non-limiting examples of a sensitive game event include producing an output related to game credits, requesting or receiving an input related to game credits, producing an output identifying a prize won, requesting or receiving an input related to a prize won, producing an output indicating a bonus spin has begun, requesting or receiving an input related to a bonus spin, requesting or receiving sensitive information from the player (e.g., PIN, password, room number, player loyalty number, etc.), producing an output related to a purchase made by the player, producing an output related to redeemed loyalty points, producing an output related to a wager, requesting or receiving an input related to a wager, or combinations thereof. Other types of sensitive game events may also be contemplated and possibly defined within a player's privacy preferences 248.

In response to receiving an indication of the sensitive game event, the method continues with the processor 204 determining, in response to executing the switchable glass control instruction set 244, that the sensitive game event is to be obfuscated or otherwise hidden (step 412). In some embodiments, the sensitive game event may be hidden from non-player observers whereas in other embodiments the sensitive game event may be hidden from the player as well as non-player observers.

In response to determining that the sensitive game event is to be obfuscated or hidden, the method continues with the processor 204, in response to executing the switchable glass control instruction set 244, generating a control signal (step 416). In some embodiments, the control signal may correspond to a signal that indicates the switchable glass 128 should be switched to an opaque state to obfuscate or hide the sensitive game event. The control signal may or may not include details of the sensitive game event (e.g., a location on the display 108, a nature of information displayed during the sensitive game event, a duration of the sensitive game event, etc.). In some embodiments, the control signal may simply correspond to a high or low logic signal that is transmittable to the driver circuit 252 and that is capable of causing the driver circuit 252 to change the switchable glass 128 from one state to another state as desired by the switchable glass control instruction set 244. The control signal is then transmitted by the processor 204 to the driver circuit 252 (step 420), which enables the driver circuit 252 to control the state of the switchable glass 128 in accordance with the control signal (step 424).

The method may further continue with the continued execution of the gaming instruction set 236. While the gaming instruction set 236 is further executed by the processor 204, the switchable glass control instruction set 244 may be executed in the background to continue monitoring inputs and/or outputs of the game events being generated by the gaming instruction set 236 (step 428). The method may continue when another indication is received at the process 204 that indicates the sensitive game event is completed (step 432).

In response to receiving the indication that the sensitive game event is completed, the processor 204 may determine, based on execution of the switchable glass control instruction set 244, that the switchable glass 128 can be switched back to a different state that discontinues the obfuscation previously implemented. Thus, the processor 204 may generate another control signal to discontinue the obfuscation (step 436). The control signal is then provided to the driver circuit 252 (step 440), which enables the driver circuit 252 to appropriately control the switchable glass 128 in accordance with the control signal (step 444). In some embodiments, the driver circuit 252 may discontinue the obfuscation by stopping the application of a current or voltage to the switchable glass 128 that was previously causing the switchable glass 128 to implement the obfuscation. Of course, if the switchable glass 128 is controlled by something other than application of a voltage or current, then the driver circuit 252 may appropriately provide or stop providing the necessary inputs to the switchable glass 128 to control the state of the switchable glass 128 in accordance with the control signal received from the processor 204.

Figure 5:
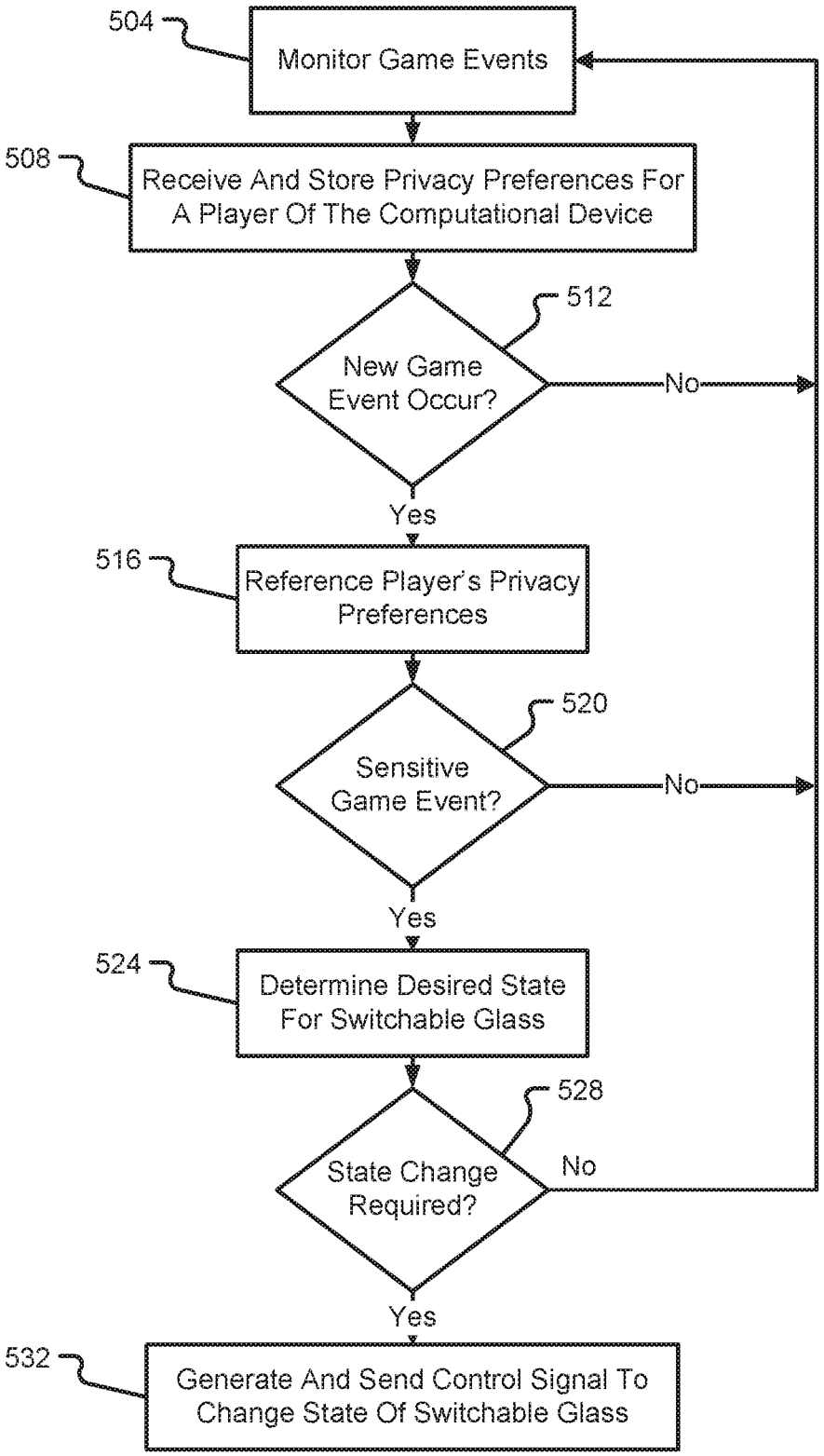
FIG. 5 is a flow chart depicting a second method in accordance with embodiments of the present disclosure.

With reference now to FIG. 5, a second method will be described in accordance with embodiments of the present disclosure. The method begins with the processor 204, via execution of the switchable glass control instruction set 244, monitoring game events that occur as a result of executing the gaming instruction set 236 (step 504).

The method continues with the processor 204 receiving and storing player privacy preferences 248 for a player that is playing at the computational device 100 (step 508). In some embodiments, the player privacy preferences 248 may be received from a player loyalty card inserted into acceptor 122. In some embodiments, the computational device 100 may include a wireless network interface 212 that enables a player to pair their personal mobile communication device with the computational device 100 (e.g., via a Bluetooth protocol, an NFC protocol, a WiFi protocol, etc.) and transmit the player privacy preferences 248 to the computational device 100 as one or more data packets. Alternatively, the player may define their privacy preferences 248 by responding to one or more prompts during game play and the player's responses to the prompts may help define the privacy preferences 248 for that player and for that particular gaming session. Upon receiving the player privacy preferences 248, the player privacy preferences 248 may be stored in memory 108 for later reference.

The method further continues with the processor 204 determining, based on the monitoring of game events, whether a new game event has occurred (step 512). If the answer to this query is negative, then the method returns back to step 504. If the answer to this query is positive, then the method continues with the switchable glass control instruction set 244 referencing the player's privacy preferences 248, which were previously stored in memory 208 (step 516).

Based on the reference to the player's privacy preferences 248, the switchable glass control instruction set 244 may determine whether the new game event corresponds to a sensitive game event (step 520). It should be appreciated that a sensitive game event for one player (as defined by that player's privacy preferences 248) may not necessarily correspond to a sensitive game event for another player. This variability may be supported by allowing each player to have their own personal player privacy preferences 248 loaded into memory 208 for their gaming session and then removed or ignored after the gaming session has concluded. For the duration of one player's gaming session, however, that player's privacy preferences 248 may be referenced to determine whether or not a game event corresponds to a sensitive game event.

If the query of step 520 is answered negatively, then the method returns to step 504. If the query of step 520 is answered positively, then the method continues with the processor 204 determining, based on execution of the switchable glass control instruction set 244, a desired state for the switchable glass 128 during the sensitive game event (step 524). If the switchable glass 128 is not already in the desired state and a state change is required (step 528), then the method proceeds with the processor 204 generating and sending a control signal to the driver circuit 252 that causes the driver circuit 252 to change the state of the switchable glass 128 (step 532). If, however, the query of step 528 is answered negatively, then the method may return back to step 504. Although not depicted, after execution of step 532, the method may return back to step 504.

Figure 6:
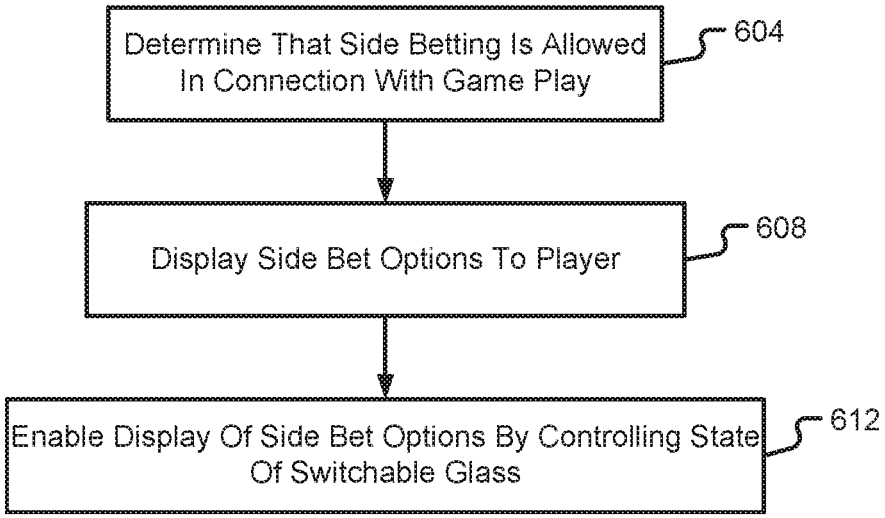
FIG. 6 is a flow chart depicting a third method in accordance with embodiments of the present disclosure.

With reference now to FIG. 6, a third method will be described in accordance with at least some embodiments of the present disclosure. The method begins with the processor 204, based on execution of the gaming instruction set 236, that a particular type of betting is allowed in connection with game play (step 604). In some embodiments, the particular type of betting may correspond to side betting at a table game.

Based on determining that the particular type of betting (e.g., side betting) is currently allowed in connection with game play, the method continues with the processor 204 determining, based on execution of the switchable glass control instruction set 244, that side bet options will be displayed to one or more players of the game (step 608). In response to making the determination to display the side bet options, the processor 204 may then enable the display of the side bet options (step 612). In some embodiments, the processor 204 may enable the display of side bet options by providing one or more control signals to the driver circuit 252 that cause the driver circuit 252 to appropriately control a state of switchable glass 128.

As will be appreciated by one skilled in the art, aspects of the present disclosure may be illustrated and described herein in any of a number of patentable classes or context including any new and useful process, machine, manufacture, or composition of matter, or any new and useful improvement thereof. Accordingly, aspects of the present disclosure may be implemented entirely hardware, entirely software (including firmware, resident software, microcode, etc.) or combining software and hardware implementation that may all generally be referred to herein as a "circuit," "module," "component," or "system." Furthermore, aspects of the present disclosure may take the form of a computer program product embodied in one or more computer readable media having computer readable program code embodied thereon.

Any combination of one or more computer readable media may be utilized. The computer readable media may be a computer readable signal medium or a computer readable storage medium. A computer readable storage medium may be, for example, but not limited to, an electronic, magnetic, optical, electromagnetic, or semiconductor system, apparatus, or device, or any suitable combination of the foregoing. More specific examples (a non-exhaustive list) of the computer readable storage medium would include the following: a portable computer diskette, a hard disk, a random access memory (RAM), a read-only memory (ROM), an erasable programmable read-only memory (EPROM or Flash memory), an appropriate optical fiber with a repeater, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device. Program code embodied on a computer readable signal medium may be transmitted using any appropriate medium, including but not limited to wireless, wireline, optical fiber cable, RF, etc., or any suitable combination of the foregoing.

Computer program code for carrying out operations for aspects of the present disclosure may be written in any combination of one or more programming languages, including an object oriented programming language such as Java, Scala, Smalltalk, Eiffel, JADE, Emerald, C++, C#, VB.NET, Python or the like, conventional procedural programming languages, such as the "C" programming language, Visual Basic, Fortran 2003, Perl, COBOL 2002, PHP, ABAP, dynamic programming languages such as Python, Ruby and Groovy, or other programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider) or in a cloud computing environment or offered as a service such as a Software as a Service (SaaS).

Aspects of the present disclosure are described herein with reference to flowchart illustrations and/or block diagrams of methods, apparatuses (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable instruction execution apparatus, create a mechanism for implementing the functions/acts specified in the flowchart and/or block diagram block or blocks.

These computer program instructions may also be stored in a computer readable medium that when executed can direct a computer, other programmable data processing apparatus, or other devices to function in a particular manner, such that the instructions when stored in the computer readable medium produce an article of manufacture including instructions which when executed, cause a computer to implement the function/act specified in the flowchart and/or block diagram block or blocks. The computer program instructions may also be loaded onto a computer, other programmable instruction execution apparatus, or other devices to cause a series of operational steps to be performed on the computer, other programmable apparatuses or other devices to produce a computer implemented process such that the instructions which execute on the computer or other programmable apparatus provide processes for implementing the functions/acts specified in the flowchart and/or block diagram block or blocks.

The invention is claimed as follows:

1. A method of operating a computational device, the method comprising:

displaying outputs of game events with a user interface of the computational device;

receiving, at a processor of the computational device, an indication of a sensitive game event;

determining, at the processor, a current mode of operation of the computational device;

determining, at the processor, a control signal to provide to a driver circuit that controls a state of transparency of switchable glass positioned in proximity with the user interface of the computational device, wherein the control signal is determined based on the current mode of operation of the computational device and the indication of the sensitive game event;

providing the control signal from the processor to the driver circuit; and adjusting, by the driver circuit and consistent with the control signal, the state of transparency of the switchable glass thereby hiding from view a graphic displayed underneath the switchable glass.

2. The method of claim 1, further comprising:

receiving, at the processor of the computational device, a second indication that the sensitive game event has transitioned to a different game event;

determining, at the processor and based on the second indication that the sensitive game event has transitioned to the different game event, a second control signal to provide to the driver circuit;

providing the second control signal from the processor to the driver circuit; and adjusting, by the driver circuit and consistent with the second control signal, the state of the switchable glass to a new state.

3. The method of claim 2, wherein the current mode of operation of the computational device comprises at least one of an attract mode and a game play mode, wherein the state comprises a translucent state, and wherein the new state comprises a transparent state.

4. The method of claim 3, wherein the sensitive game event comprises a period of time during which the user interface of the computational device is displaying sensitive game data and wherein the different game event comprises a non-sensitive game event in which the sensitive game data is no longer displayed by the user interface of the computational device.

5. The method of claim 1, further comprising:

determining, at the processor of the computational device, privacy preferences for a player of the computational device; and referencing, at the processor of the computational device, the privacy preferences in connection with determining the control signal to provide to the driver circuit.

6. The method of claim 5, further comprising:

receiving, via a communication interface of the computational device, the privacy preferences from a mobile device of the player; and storing, by the processor of the computational device, the privacy preferences in memory of the computational device.

7. The method of claim 1, wherein the sensitive game event comprises a side bet event and wherein the switchable glass is positioned in an overlapping relationship with the user interface, the method further comprising:

determining, by the processor of the computational device, that the side bet is allowed in connection with game events played at the computational device;

displaying, by the processor of the computational device, side bet options through the user interface; and enabling, by the processor of the computational device and driver circuit, the display of side bet options to be viewable through the switchable glass.

8. A system, comprising:

switchable glass;

a driver circuit that adjusts a state of the switchable glass by providing different levels of current to the switchable glass;

a processor coupled with the driver circuit; and a computer-readable storage medium, coupled with the processor, comprising instructions that are executable by the processor, wherein the instructions comprise instructions that:

provide a player with a presentation of a plurality of game events;

determine a first game event from the plurality of game events comprises a sensitive game event;

provide a control signal to the driver circuit that causes the driver circuit to adjust the state of the switchable glass to a translucent state during the first game event thereby hiding from view a graphic displayed underneath the switchable glass during the first game event;

determine that a device comprising the switchable glass has switched from a game play mode to an attract mode; and in response to determining that the device has switched to the attract mode, adjust the control signal provided to the driver circuit to cause the driver circuit to adjust the state of the switchable glass to a transparent state.

9. The system of claim 8, wherein the instructions further comprise:

instructions that determine the first game event has completed and, in response thereto, provide a second control signal to the driver circuit that causes the driver circuit to further adjust the state of the switchable glass to the transparent state.

10. The system of claim 8, further comprising:

a table game surface that is positioned in an overlapping relationship with the switchable glass such that a betting option provided on the table game surface is hidden when the state of the switchable glass is adjusted to the translucent state.

11. The system of claim 8, wherein the sensitive game event comprises a betting event in which account information for the player is presented.

12. The system of claim 8, wherein the instructions further comprise:

instructions that receive privacy preferences for the player; and instructions that reference the privacy preferences for the player in connection with determining the first game event from the plurality of game events comprises the sensitive game event.

* * * * *